United States Patent [19]

Evans, Jr.

[11] 4,256,167

[45] Mar. 17, 1981

[54] APPARATUS FOR CENTRIFUGAL CASTING

[76] Inventor: Dwight L. Evans, Jr., 509 Windsor Ter., Anniston, Ala. 36201

[21] Appl. No.: 23,081

[22] Filed: Mar. 23, 1979

[51] Int. Cl.[3] ..... B22D 13/02; B22D 13/04; B22D 13/10

[52] U.S. Cl. ..... 164/298; 164/114; 164/297; 164/326

[58] Field of Search ..... 164/297, 298, 286, 114, 164/118, 299, 300, 301, 117

[56] References Cited

U.S. PATENT DOCUMENTS

| | | | |
|---|---|---|---|
| 1,113,017 | 10/1914 | Jovanneau | 164/298 |
| 1,634,914 | 7/1927 | Reichold | 164/298 X |
| 1,805,961 | 5/1931 | Thomas | 164/298 X |
| 1,944,168 | 1/1934 | Camerota | 164/298 |
| 1,963,400 | 6/1934 | Campbell | 164/298 X |
| 2,023,040 | 12/1935 | Adams, Jr. | 164/297 |
| 4,004,632 | 1/1977 | Fort et al. | 164/297 |

*Primary Examiner*—Robert D. Baldwin
*Assistant Examiner*—Gus T. Hampilos
*Attorney, Agent, or Firm*—Hugh P. Carter

[57] ABSTRACT

Disclosed is an apparatus for centrifugal casting in which the support for the rotating permanent or semi-permanent molds is so constructed and arranged as to insure long life for the bearings which support the rotating parts of the mechanism. Also, the construction permits the rotating molds to be substantially enclosed by a housing so that water may be sprayed down onto the units during the casting operation without at the same time spraying the bearings or otherwise wetting the portions of the machinery required to be kept dry. Still further, the improved casting device comprises essentially three supporting shafts, one of which may be driven, so relatively located as to simultaneously support for rotating two molds, whereby two castings may be made from a supporting and driving shaft system powered by a single motor or the like. The apparatus also is adapted to be mounted in multiple units upon an indexing turn-table or the like so that there may be several stations, operating simultaneously, as for instance, a pouring station, several cooling stations, an extraction station, etc.

3 Claims, 4 Drawing Figures

FIG. 2
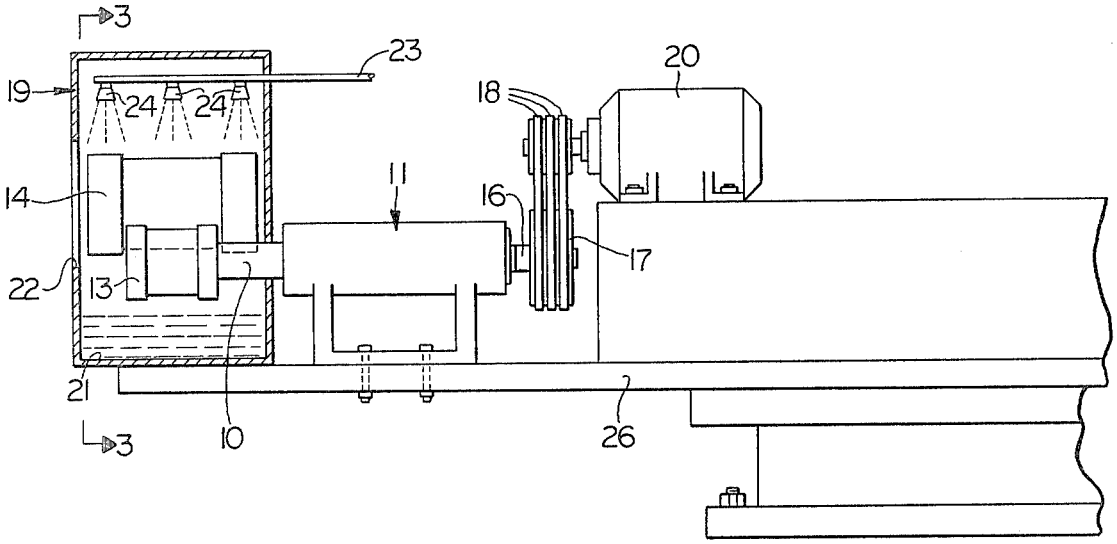
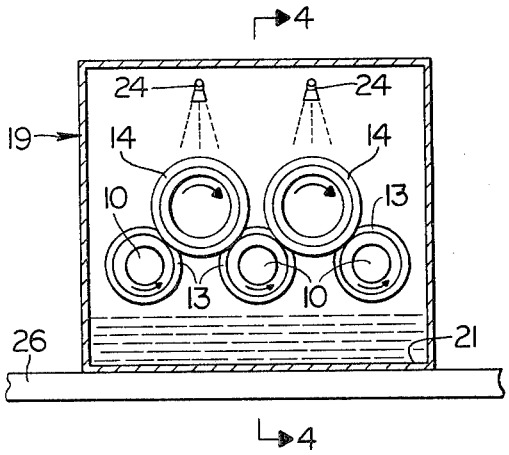
FIG. 3
FIG. 1
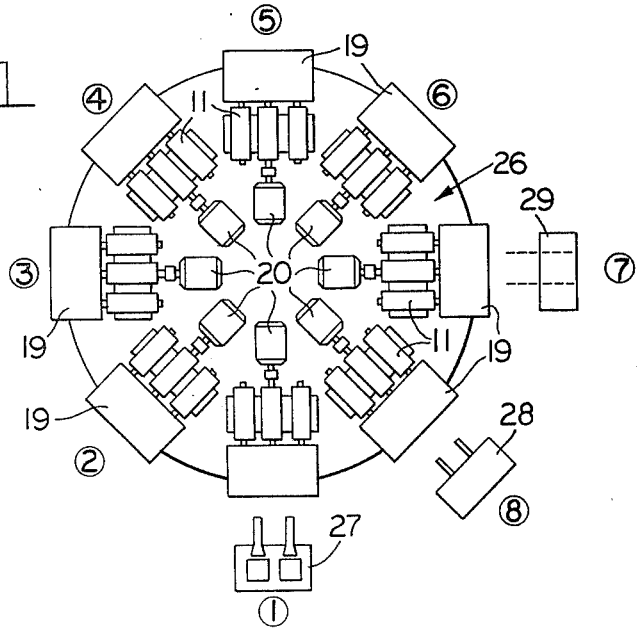

APPARATUS FOR CENTRIFUGAL CASTING

This invention relates to centrifugal casting apparatus and has for one of its objects the provision of an improved, simplified apparatus particularly adapted for producing short castings such, for instance, as cylinder liners for internal combustion engines.

Another object of my invention is to provide casting apparatus in which the molds are mounted on the ends of cantilever supported driving and supporting shafts, this arrangement affording the advantage, among others, of permitting the molds to be sprayed for cooling while enclosed in a housing, and also permitting the use of long, rugged bearings for supporting the shafts which drive the rotary molds.

Another object of my invention is to provide apparatus of the character designated in which two centrifugal molds may be rotated simultaneously from a common driven shaft, for instance, by providing three parallel shafts adapted simultaneously to support for rotation two molds, with means to drive one of the shafts, preferably the central one.

My invention also contemplates apparatus which may be especially adapted for use in a multiple-station type of apparatus, namely, in which several of the individual devices heretofore described may be supported on a common turn-table so that at one station the molds may be sprayed, at another the molten metal may be poured, at others cooled, and at a final station an extraction position in which the cast products are removed.

Apparatus illustrating features of my invention is shown in the accompanying drawings, forming a part of this application, in which:

FIG. 1 is a diagrammatic plan view of casting apparatus embodying a multiplicity of individual units and mounted for indexing or rotation upon a supporting table;

FIG. 2 is a vertical elevational view of one of the casting devices and drive therefor, partly in section and enlarged over the showing of FIG. 1;

FIG. 3 is a detail sectional view taken generally along line 3—3 of FIG. 2; and, FIG. 4 is an enlarged detail sectional view through one of the driven rotary mold support shafts, the view being taken generally along line 4—4 of FIG. 3.

Figure 4:
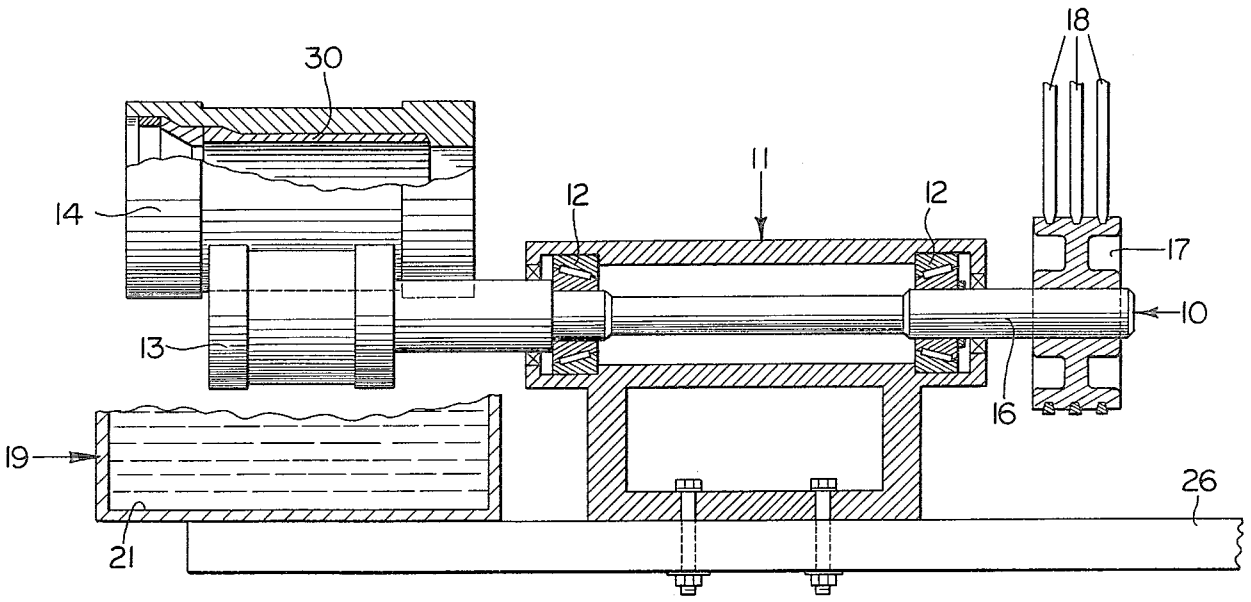

Referring now to the drawings for a better understanding of my invention I will first describe the details of one of the individual casting units.

Referring particularly to FIGS. 2 and 4, my improved apparatus comprises, in its preferable form, three horizontal, parallel shafts indicated at 10. These shafts are supported in bearings indicated generally by the numeral 11 and which in detail may comprise antifriction bearings 12 inside of a housing. The outer ends of the shafts 10 carry mold supporting members 13 and it is on these members or collars that the permanent or semipermanent molds 14 are supported for rotation.

As will be understood, the middle shaft 10 is elongated to provide a driving end or section 16 which projects from the rear end of the bearing housing 11. A pulley 17 is mounted on the end 16 of the middle shaft 10 and this shaft may be driven through a plurality of V-belts 18 from an electric motor 20. In view of the fact that the ends of the shaft carrying the mold support members 13 project cantileverwise from the front of the bearings 11, I am enabled partially to enclose these ends of the shaft with a housing or shield 19. This may be in the form of an enclosed box-like member having a bottom 21 and an opening 22 in the outer end thereof through which the molds may be removed and through which they may be poured, as desired. For cooling purposes water may be admitted through a conduit 23 to a plurality of spray heads 24. In view of the fact that the molds are substantially closed by the housing 19, water used to cool the molds may collect in the bottom of the housing and be used over again.

In view of the disclosure so far given, it will be seen that my improved apparatus is especially adapted for association with like apparatus to provide a multi-station casting device or machine. Thus, in FIG. 1, I show a turn-table or supporting plate 26 on which a plurality of the machines so far described are mounted. Thus, a plurality of the machines may be bolted to the plate or deck 26. As shown in FIG. 1 the stations are numbered 1 through 8. At station 1 the two molds 14 may be simultaneously poured through the pouring apparatus diagrammatically illustrated at 27. At the same time, at station 8, just ahead of station 1 in the sense of rotation, the insides of the molds or flasks 14 may be sprayed with a suitable refractory by the apparatus illustrated diagrammatically by the numeral 28. Once the castings are poured, the machine is indexed to station 2 where cooling takes place. This cooling continues through stations 3, 4 and 5 and at station 7 the product is removed from the molds as indicated diagrammatically by the lines 29.

From the foreoing it will be seen that I have devised an improved apparatus for making centrifugal castings, particularly relatively short castings such for instance as the cylinder liner shown in FIG. 4 and indicated by the numeral 30. My invention is characterized by the fact that the shafts on which the molds are supported are mounted in cantilever fashion, permitting the enclosure of the molds, permitting three shafts to be mounted alongside each other thus to simultaneously rotate two molds, and permitting the molds to be enclosed by the housing 19 or a similar enclosure. Furthermore, the arrangement of the shafts protects the bearings and removes them by and large from the heat of the molten metal, thus prolonging the life of the bearings and facilitating the lubrication thereof. My invention also is adapted to be used in multiple form on an indexing table or support as shown in FIG. 1, thereby providing a machine by which large volumes of castings may be made with a minimum amount of labor.

While I have shown my invention in but one form, it will be obvious to those skilled in the art that it is not so limited, but is susceptible of various changes and modifications without departing from the spirit thereof.

What I claim is:

1. An apparatus for centrifugally casting molten metals and the like comprising:

(a) a pair of side-by-side, substantially horizontal, parallel bearings, (b) shafts rotatably mounted in said bearings, (c) means operatively associated with at least one of said shafts at one end thereof to apply power to rotate at least one of said shafts, (d) said shafts projecting in unsupported, cantilever fashion from said bearings at ends thereof opposite the one end to which power is applied to said one of the same, and (e) cylindrical collars on the extremities of said unsupported projecting portion of said shafts, said collars being located beneath an axis of rotation of a centrifugal mold mounted on said collars of said unsupported projecting portions of said shafts, said collars forming the sole support for said mold.

2. An apparatus for centrifugally casting molten metals and the like comprising:

(a) at least three side-by-side substantially horizontal parallel bearings, (b) a shaft mounted in each of said bearings, each of said shafts projecting in unsupported, cantilever fashion from an associated bearing at one end thereof, (c) cylindrical collars on the extremities of the unsupported projecting portions of the shafts, said collars being located beneath axes of rotation of a pair of centrifugal molds mounted on the unsupported projection portions of said shafts, said collars forming the sole support for said pair of centrifugal molds disposed to receive molten metal to be cast, and (d) means associated with an end of the centermost one of said three shafts remote from said collar bearing unsupported projecting portion for applying power to rotate the same.

3. Apparatus as defined in claim 2 in which the molds are interiorally configured to receive a quantity of loose material such as sand which forms a casting surface for the outer surface of castings made therein.

* * * * *